US009010069B2

(12) United States Patent
Bernard

(10) Patent No.: US 9,010,069 B2
(45) Date of Patent: Apr. 21, 2015

(54) PROTECTIVE POST COVERING

(76) Inventor: John P. Bernard, Vero Beach, FL (US)

( * ) Notice: Subject to any disclaimer, the term of this patent is extended or adjusted under 35 U.S.C. 154(b) by 0 days.

(21) Appl. No.: 13/506,540

(22) Filed: Apr. 26, 2012

(65) Prior Publication Data

US 2013/0288068 A1 Oct. 31, 2013

(51) Int. Cl.
*E04C 3/00* (2006.01)
*E04H 12/22* (2006.01)

(52) U.S. Cl.
CPC ..... *E04H 12/2292* (2013.01); *Y10T 428/12354* (2015.01); *Y10T 428/24198* (2015.01)

(58) Field of Classification Search
USPC ..... 52/831, 834, 835, 842–845; 138/118.1; 256/1, 19, 21
See application file for complete search history.

(56) References Cited

U.S. PATENT DOCUMENTS

D300,566 S * 4/1989 Fein ..... D25/124
4,843,793 A * 7/1989 Ayers ..... 52/169.12
5,778,626 A * 7/1998 Hellsten ..... 52/844
5,791,115 A * 8/1998 Nicolai et al. ..... 52/843
5,899,239 A * 5/1999 Coulis ..... 138/163
6,286,281 B1 * 9/2001 Johnson ..... 52/592.1
6,308,464 B1 * 10/2001 Demartini ..... 52/16
7,168,220 B2 * 1/2007 Owoc et al. ..... 52/844
7,442,875 B2 * 10/2008 Burdy et al. ..... 174/93
7,647,737 B2 * 1/2010 Morello ..... 52/245
7,997,044 B2 * 8/2011 Green et al. ..... 52/834
8,074,424 B2 * 12/2011 Waters et al. ..... 52/834
2005/0271467 A1 * 12/2005 Ong ..... 403/359.1

* cited by examiner

*Primary Examiner* — Beth Stephan
(74) *Attorney, Agent, or Firm* — Stephen C. Thomas

(57) ABSTRACT

A protective covering for a post, such as a mail box post, used to prevent damage to such a post by grass trimming devices such as weed-eaters. The protective covering, which may be rust resistant metal or other rust resistant material, may be formed by bending a single piece of material into a four-sided shape, open on top and bottom, with two open ends each having a complimentary interlocking fold formed on its open ends. The four-sided shape may be flexible so that it may be flexed into an open position, placed around the post to be protected, and closed upon itself being locked in place by the complimentary interlocking folds forming a protective covering surrounding the post. No screws, nails or other retaining hardware are required for holding the protective covering place.

10 Claims, 1 Drawing Sheet

PROTECTIVE POST COVERING

BACKGROUND

For years there have been mail box posts in front of houses. Since the invention of the weedeater in around 1972, the wooden mailbox post has been getting whipped up by the plastic weedeater line. The grass grows next to the mailbox post and when the weedeater trims the grass around the post it can't help but strike the post with the weedeater line. This causes the post to get chewed up, and whipped away. The Protective Post Covering is designed to eliminate this problem.

SUMMARY OF THE INVENTION

The Protective Post Covering is designed as a strong, flexible, per-formed one piece unit, that is easy to install. The user simply flexes open the covering and places it around the wooden mailbox post, and the covering snaps back to its original shape, surrounding the post and protecting it from weedeater damage. The covering also has a self locking feature that holds it securely in place.

DETAILED DESCRIPTION OF THE INVENTION

Figure 3:
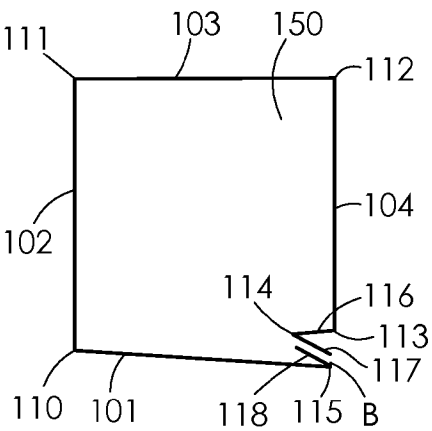
FIG. 3 shows a top view of the covering with the edges near one another.
Figure 4:
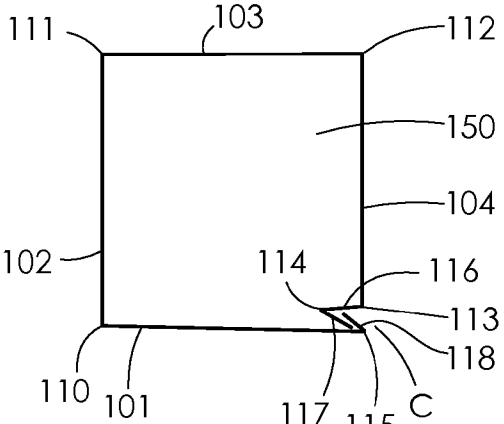
FIG. 4 shows a top vie of the covering closed.
Figure 2:
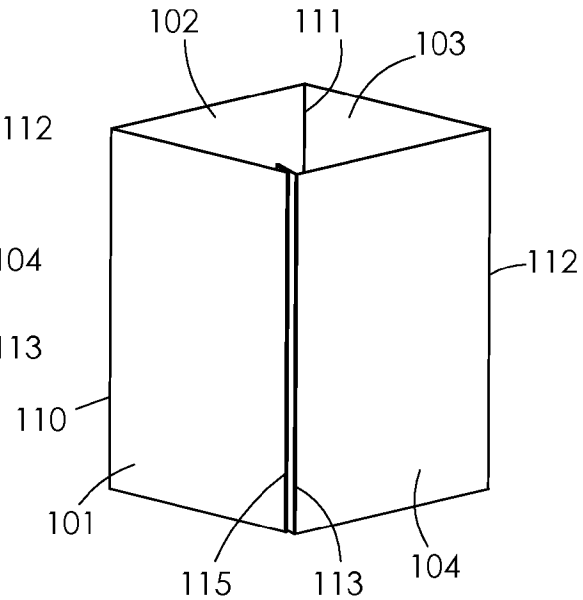
FIG. 2 shows a side view of the covering closed.

Referring now to FIGS. 1, 2, 3 and 4, the protective covering of the invention may be formed by a material strip, which may be a strip of galvanized sheet metal or any other material that may be flexed, as depicted. The material strip may be folded along a first fold line 110, a second fold 111, a third fold 112 and a fourth fold 113 forming an enclosed shape having an open top and open bottom further forming an opening through the enclosed shape 150 for surrounding a post to be protected, and comprising first side 101, second side 102, third side 103 and fourth side 104 as depicted in FIGS. 2 and 4. The enclosed shape may be rectangular in cross section, and, further, may be square. The protective covering may have an opening A that is expandable due to the flexibility of the material strip in general but specifically at fold lines 110, 111, 112 and 113. Side 101 and side 104, each of which have one end comprising one side of opening A, may further comprise interlocking folds forming a releasable engagement between them. Regarding side 101, a retaining fold 118 may be created by folding a section of the material strip back on itself at fold line 115 as depicted. Similarly, regarding side 104, folds 116 and 117 may be created by folding a section of the material strip back on itself at fold lines 113 and 114 as depicted, creating a V-section of material that is adapted to receive retaining fold 118 in a releasable engagement when the protective covering is closed upon itself as depicted in FIGS. 2 and 4, and specifically as depicted by area "C" in FIG. 4. In this manner, retaining fold 118 is received by the V-section formed by folds 116 and 117, securing sides 101 and 104 together in a releasable engagement and securely holding the covering into an enclosed shape having an open top and an open bottom. The covering may be opened to receive a post to be protected by expanding gap A. When the covering is disposed in an un-flexed but open position, gap A may be almost closed, as depicted by B in FIG. 3.

Referring now to FIGS. 1, 2, 3 and 4, the protective covering the invention may be formed by a material strip, which may be strip of galvanized sheet metal or any other material that may be flexed, as depicted. The material strip may be folded along a first fold line 110, a second fold 111, a third fold 112 and a fourth fold 113 forming an enclosed shape having an open top and open bottom further forming an opening through the enclosed shape 150 for surrounding a post to be protected, and comprising first side 101, second side 102, third side 103 and fourth side 104 as depicted in FIGS. 2 and 4. The enclosed shape may be rectangular in cross section, and, further, may be square. The protective covering may have an opening A that is expandable due to the flexibility of the material strip in general but specifically at fold lines 110, 111, 112 and 113. Side 101 and side 104, each of which have one end comprising one side of opening A, may further comprise interlocking folds forming a releasable engagement between them. Regarding side 101, a retaining fold 118 may be created by folding a section of the material strip back on itself at fold line 115 as depicted. Similarly, regarding side 104, folds 116 and 117 may be created by folding a section of the material strip back on itself at fold lines 113 and 114 as depicted, creating a V-section of material that is adapted to receive retaining fold 118 in a releasable engagement when the protective covering is closed upon itself as depicted in FIGS. 2 and 4, and specifically as depicted by area "C" in FIG. 4. In this manner retaining fold 118 is received by the V-section formed by folds 116 and 117, securing sides 101 and 104 together in a releasable engagement and securely holding the covering into an enclosed shape having an open top and an open bottom. The covering may be opened to receive a post to be protected by expanding gap A. When the covering is disposed an un-flexed but open position, gap A may be almost closed, as depicted by B in FIG. 3.

Figure 1:
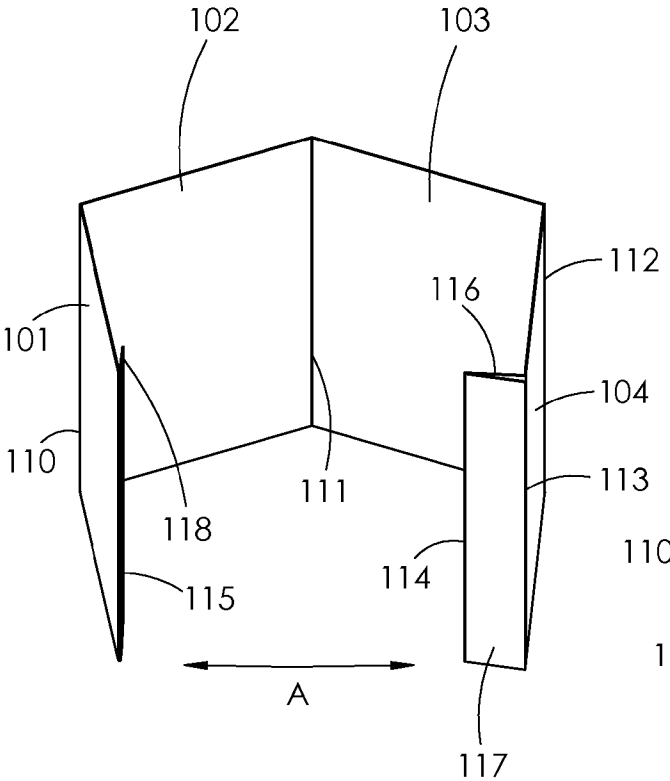
FIG. 1 shows a side view of the covering open.

Still referring to FIGS. 1, 2, 3 and 4, when it is desired to assemble the protective covering onto a post, which may be for example a wooden post, gap A may be expanded as depicted in FIG. 1, which expansion is enabled by flexing of the material strip at fold lines 110, 111, 112 and 113. The covering may then be placed around a post to be protected and fold 118 may be received by the V-section formed by folds 116 and 117, securing sides 101 and 104 together and securely holding the covering into an enclosed shape surrounding the post to be protected without the need for retaining hardware such as screws or nails.

The invention claimed is:

1. A protective covering, comprising:

a material strip having a first side, a second side, a third side and a fourth side, wherein said first, second, third and fourth sides are folded along first, second and third fold lines between the sides, one of the fold lines between each of the sides;

said first side having an edge opposite the first fold line comprising a retaining fold, wherein said retaining fold is formed by a portion of said material strip folded back upon itself along a fourth fold line; and said fourth side having an edge opposite the third fold line comprising a V-section formed by a first fold and a second fold along a fifth fold line and a sixth fold line, wherein said V-section is adapted to receive said retaining fold in said first side in a releasable engagement forming an enclosed shape having an open top and an open bottom.

2. The protective covering as in claim 1, wherein when said retaining fold in said first side is received by and is releasably engaged with said V-section in said fourth side.

3. The protective covering as in claim 1, wherein said material strip comprises galvanized metal.

4. The protective covering as in claim 2, wherein said material strip comprises galvanized metal.

5. The protective covering as in claim 2, wherein said enclosed shape is rectangular.

6. The protective covering as in claim 3, wherein said enclosed shape is rectangular.

7. The protective covering as in claim 4, wherein said enclosed shape is rectangular.

8. The protective covering as in claim 2, wherein said enclosed shape is square.

9. The protective covering as in claim 3, wherein said enclosed shape is square.

10. The protective covering as in claim 4, wherein said enclosed shape is square.

* * * * *